United States Patent [19]

Krenkel et al.

[11] Patent Number: 4,985,970

[45] Date of Patent: Jan. 22, 1991

[54] SEAMING MACHINE TO MANUFACTURE AN INSERTION-TYPE SEAM FOR MAKING A CLOTH BELT ENDLESS

[75] Inventors: Bernhard Krenkel; Heinz Joos, both of Heidenheim, Fed. Rep. of Germany

[73] Assignee: F. Oberdorfer GmbH & Co. KG IndustriegewebeTechnik, Fed. Rep. of Germany

[21] Appl. No.: 222,771

[22] Filed: Jul. 22, 1988

Related U.S. Application Data

[63] Continuation-in-part of Ser. No. 78,992, Jul. 29, 1987, and a continuation-in-part of Ser. No. 68,631, Jun. 30, 1987, which is a continuation-in-part of Ser. No. 808,553, Dec. 13, 1985, said Ser. No. 78,992, is a continuation of Ser. No. 808,553, Dec. 13, 1985.

[30] Foreign Application Priority Data

Dec. 21, 1984 [DE] Fed. Rep. of Germany ..... 3446941

[51] Int. Cl.[5] ..... D06H 5/00; D03D 25/00

[52] U.S. Cl. ..... 28/141; 139/383 AA

[58] Field of Search ..... 28/141; 139/383 AA

[56] References Cited

U.S. PATENT DOCUMENTS

| | | | |
|---|---|---|---|
| 2,786,256 | 3/1957 | Axelsson | 28/141 |
| 3,238,594 | 3/1966 | Schuster | 28/141 |
| 3,962,762 | 6/1976 | Alexeff | 28/141 |
| 4,557,025 | 12/1985 | Eglin | 28/141 |

*Primary Examiner*—Werner H. Schroeder
*Assistant Examiner*—Bradley Kurtz DeSandro
*Attorney, Agent, or Firm*—Gifford, Groh, Sprinkle, Patmore and Anderson

[57] ABSTRACT

The invention is directed to a method of manufacturing an insertion-type seam for making a cloth belt, especially a wire cloth, endless, in which the warp ends of each cloth side are interwoven with an auxiliary warp strip, and to a seaming machine for carrying out the method. In order to mechanize and automate the conventionally required intricate and time-consuming manual work for preparing the insertion-type seam and to thereby achieve a significant relief of personnel and thus an improvement in productivity and the quality of insertion-type seams, it is proposed that the warp ends after unravelling of the right-hand and the left-hand cloth sides are strung in a magazining bunch, and thereafter mechanically individually separated in accordance with the weaving order and alternatingly returned and re-woven about a central wire of any desired cross-sectional area, said central wire being disposed in the center of the auxiliary warp strip and consisting of at least one wire, so that in accordance with the weaving progress a warp end of the right-hand and the left-hand cloth side alternately winds about the central wire, while the respective opposite warp is re-woven without being looped about the central wire, the warp ends after insertion into the shed made in accordance with the weaving order being beaten up in parallel to the selvedge.

14 Claims, 17 Drawing Sheets

SEAMING MACHINE TO MANUFACTURE AN INSERTION-TYPE SEAM FOR MAKING A CLOTH BELT ENDLESS

The present application is a continuation-in-part of our copending application Ser. No. 078,992, filed July 29, 1987, which is a continuation of our copending application Ser. No. 808,553, filed Feb. 14, 1977. The present application is also a continuation-in-part of our copending application 068,631, filed June 30, 1987, which is a continuation-in-part of our copending application Ser. No. 808,553, filed Dec. 13, 1985. These applications are incorporated herein by reference thereto.

BACKGROUND OF THE INVENTION

The invention is directed to a method of manufacturing an insertion-type seam for making a cloth belt especially a wire cloth or a paper-making fabric endless. The invention is also directed to a seaming machine for carrying out the method.

Cloth belts of the above-specified type comprise especially dehydration or dryer wire cloths. As compared to endless-woven wire cloths or wire cloths made endless by a woven seam, wire cloths with an insertion-type seam offer the advantage that they may be made endless in the suction extractor or in the dryer section of the paper-making machine itself by joining the two prepared cloth ends by means of an insertion wire. Up to now, these insertion-type seams have been prepared manually by re-weaving or re-splicing the warp threats of every cloth side of two cloth ends to be joined by a seam, so that a series of warp thread loops is formed on each side through which then the common joining insertion-wire may be passed.

This preparation of such an insertion-type seam which is described in European Patent No. 0043441 and German Utility Model 81 22 451, with regard to making dehydration wire cloths with one seam endless, is very labour-consuming and expensive since it is performed manually.

SUMMARY OF THE INVENTION

It is therefore an object of the invention to provide a method, and it is a further object of the invention to provide a machine, permitting mechanization and automation of the intricate and time-consuming manual work, whereby a significant relief of personnel and thus an increase in productiveness and an improvement in the quality of insertion-type seams can be achieved.

These and other objects of the invention are accomplished in that the warp ends after unravelling of the right-hand and the left-hand cloth side are strung in a magazining bunch, and mechanically individually separated in accordance with the weaving order and alternatingly returned and rewoven about a central wire of any desired cross-sectional area, said central wire being disposed in the center of the auxiliary warp strip and consisting of at least one wire, so that in accordance with the weaving progress a warp end of the right-hand and the left-hand cloth side alternately winds about the central wire, while the respective opposite warp is rewoven without being looped about the central wire, the warp ends after insertion into the shed made in accordance with the weaving order being beaten up in parallel to the selvedge.

According to another mode of operation, the method of the invention resides in that the warp ends, after unravelling of the right-hand and left-hand cloth ends, are strung to form a magazining bunch, mechanically separated in accordance with the weaving order and individually respectively re-woven about a loop of a wire helix, wherein when two wire helices are used the same are disposed in parallel and are not interconnected, and wherein the left-hand and the right-hand cloth ends are retained in such a way that any lateral slipping or displacement is prevented. Thereafter, the wire helices are interconnected by means of a common inserted wire externally of the seaming machine.

According to a further proposal, the method of the invention resides in that the warp ends, after unravelling of the right-hand and left-hand cloth ends, are strung to form a magazining bunch, and mechanically separated in accordance with the weaving order and individually respectively re-woven about a loop of a wire helix, wherein when two wire helices are used the same are disposed in parallel fitted into each other, and wherein progressing with the seam a central wire is fit into both helices, connecting them and thus both cloth ends with each other such that lateral slipping between both cloth ends and on the seaming machine is prevented.

To perform the method according to the invention a seaming machine is used which is characterized by separators disposed on either side of the insertion-type seam to be made for removing and separating the warp ends from the warps of each cloth side which are arranged in magazining bunches, a gripper system comprising transfer grippers and drawing-in grippers for inserting the separated individual threads into a shed preformed from auxiliary warps by a shedding mechanism, the individual threads adapted to be beaten up to the respective selvedge within said shed by a driven lathe respectively provided for each seaming half, wherein subsequent to beating-up the individual threads are re-woven by means of the gripper system either about one or several central wires or wire helices or, avoiding the central wire or wires or wire helices directly into their own side of the cloth.

Additional objects, features and advantages of the invention will become apparent from the subclaims.

BRIEF DESCRIPTION OF THE DRAWINGS

The invention will be described in detail hereinbelow with reference to the embodiments thereof illustrated in the drawings, in which.

DETAILED DESCRIPTION OF THE PREFERRED EMBODIMENTS OF THE PRESENT INVENTION

Figure 1:
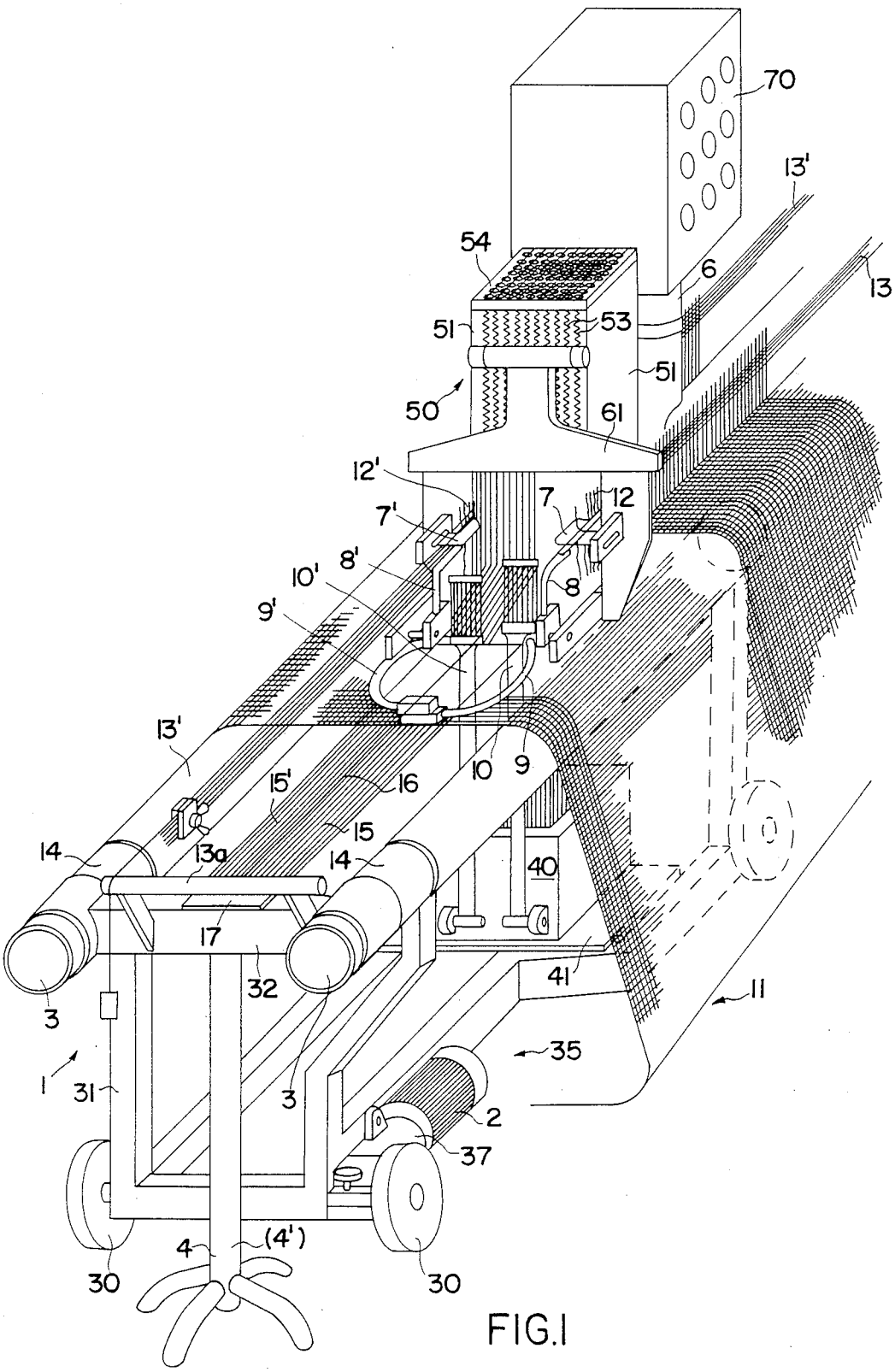
FIG. 1 is a schematic isometric front view of the seaming machine according to the invention.

As will be apparent from FIGS. 1, 12–14, the seaming machine comprises essentially a traveling mechanism 1, a frame 4, 4', a jacquard head 40, a harness 50, a single thread suspension 60, a thread separator 7, 7', a transfer gripper 8, 8', a threading gripper 9, 9', a lathe 10, 10', a control console 70, an electric-control unit 80 and a pneumatic-control unit 90.

Figure 2:
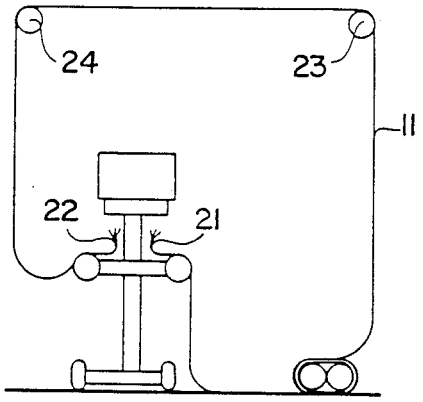
FIG. 2 is a reduced-scale end view of the machine illustrated in FIG. 1, in which the cloth belt that is to be made endless is passed like a tent across the seaming machine.
Figure 2A:
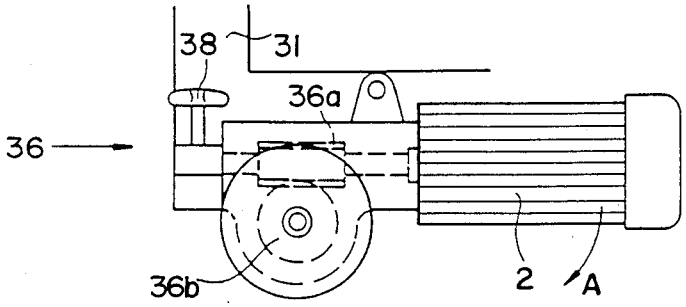
FIG. 2*a* is a detailed side view of the device for the connection and disconnection of the drive motor of the seaming machine.
Figure 12:
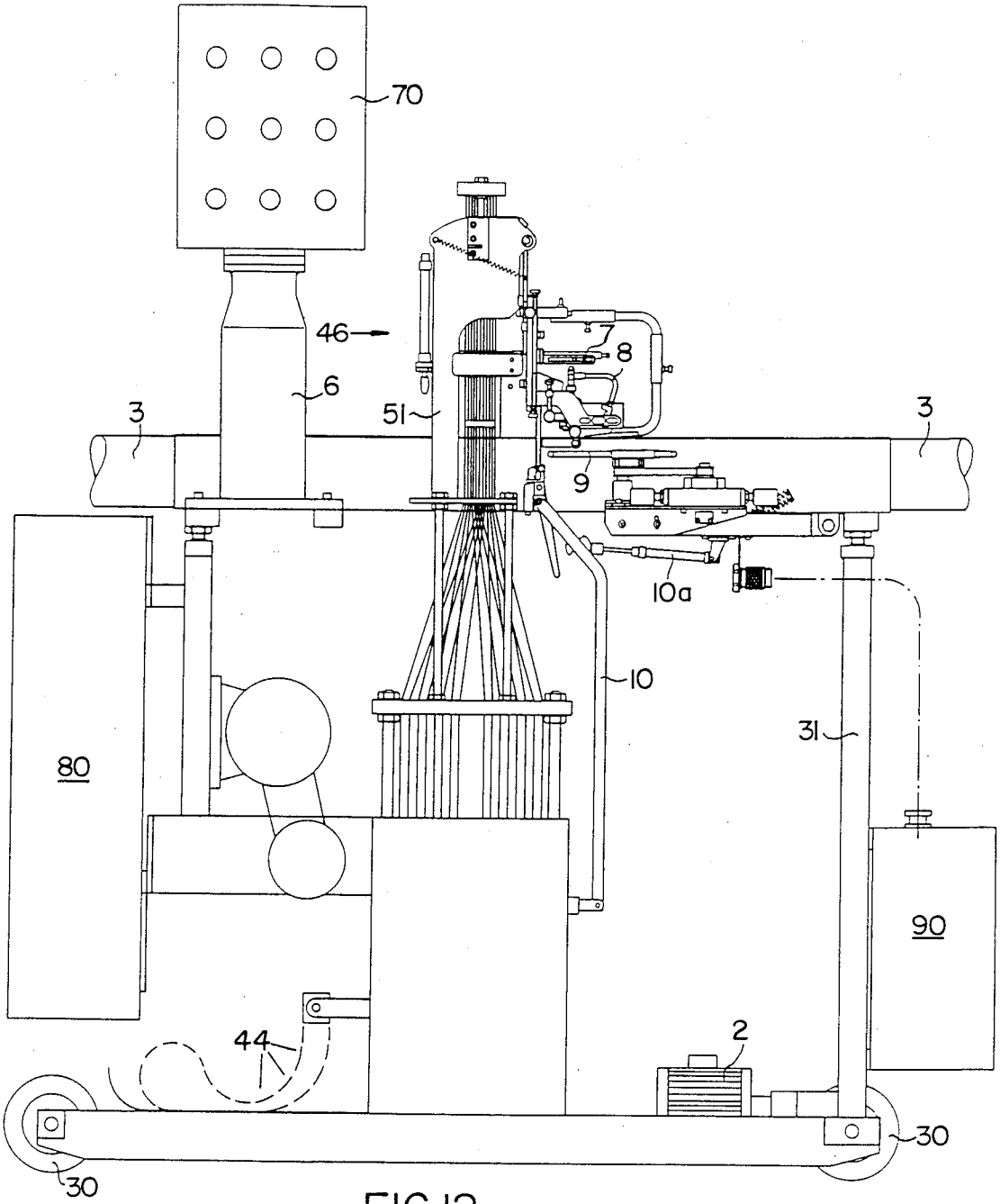
FIG. 12 is a sectional view of the seaming machine shown in FIG. 1 in a longitudinal direction along a line of symmetry.
Figure 13:
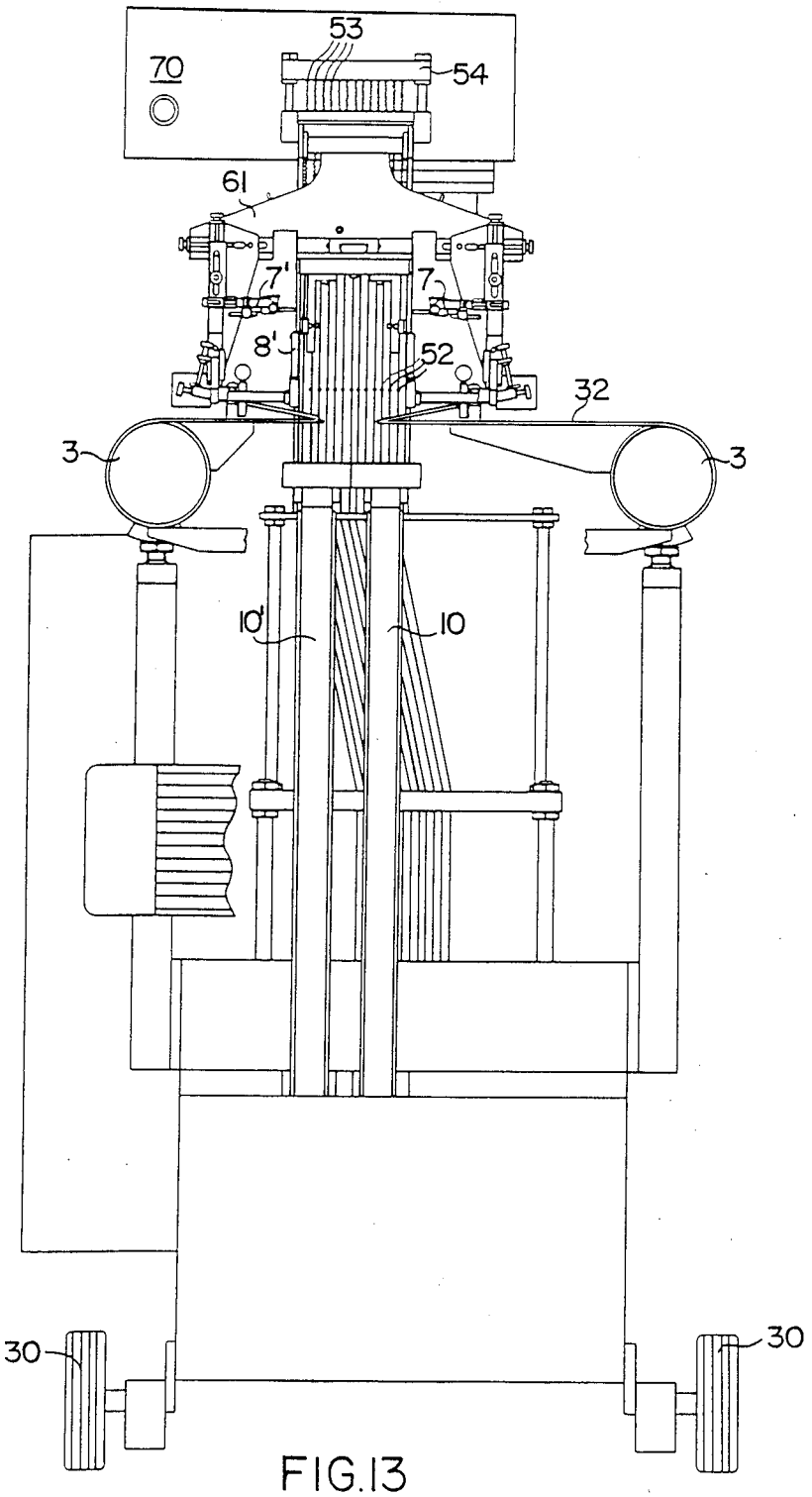
FIG. 13 is a cross-sectional view of the seaming machine shown in FIG. 1.

As will be apparent from FIGS. 1, 12 and 13, the seaming machine is mounted on the traveling mechanism 1 comprising a frame 31 movable on wheels 30, said frame adapted to be moved via a controlled drive motor 2 with the rhythm of the weaving progress. The traveling mechanism 1 is a welded structure and serves to support the machine table 32, the brackets 6, 41, 51, 61 of the above identified units as well as the feed unit 35 during the weaving process. The traveling mechanism 1 can be driven automatically with a gear-break motor 2 followed by a high reduction gear 37. Thus for instance a feed of 0.01575 inch/sec (0.4 mm/sec) can be achieved. The feed of the seaming machine is controlled dependent on the density of the cloth, whereby the duration of the moving pulse is to be entered in the program by means of a timer depending on warp count division. Without the weaving program the seaming machine can be run by means of the gear-motor 2 with push buttons connected therewith in a forward and a backward direction. The forward direction concurs with the seaming direction. This mode of operation has been provided for traveling across short distances e.g. for the start-up of a weaving process or during the occurrance of a fault. Referring now to FIG. 2*a*, if it is necessary to shift the seaming machine over larger distances, as would be the case when a seam is finished and a wire removed, or to return the seaming machine into the start position, then the gear-break motor 2, 37 can be disconnected. This can be done by means of a disconnect device 36 comprising a star handle screw 38. The seaming machine can then be moved manually. To disconnect the gear-break motor 2 the star handle screw 38 (FIG. 2*a*) is slackened, while the gear-break motor 2 is held firmly until the screw 38 is free. Then the gear-break motor 2 is pushed downwards on its hinge in the direction of arrow A. The worm gear 36*a* is then disconnected. For automatic operation the gear-break motor 2 is pushed upward on its hinge and the seaming machine is moved sideways until the worm gear 36*a* engages in the worm wheel 36*b*. Following this the star handle screw 38 can be retightened.

Figure 14:
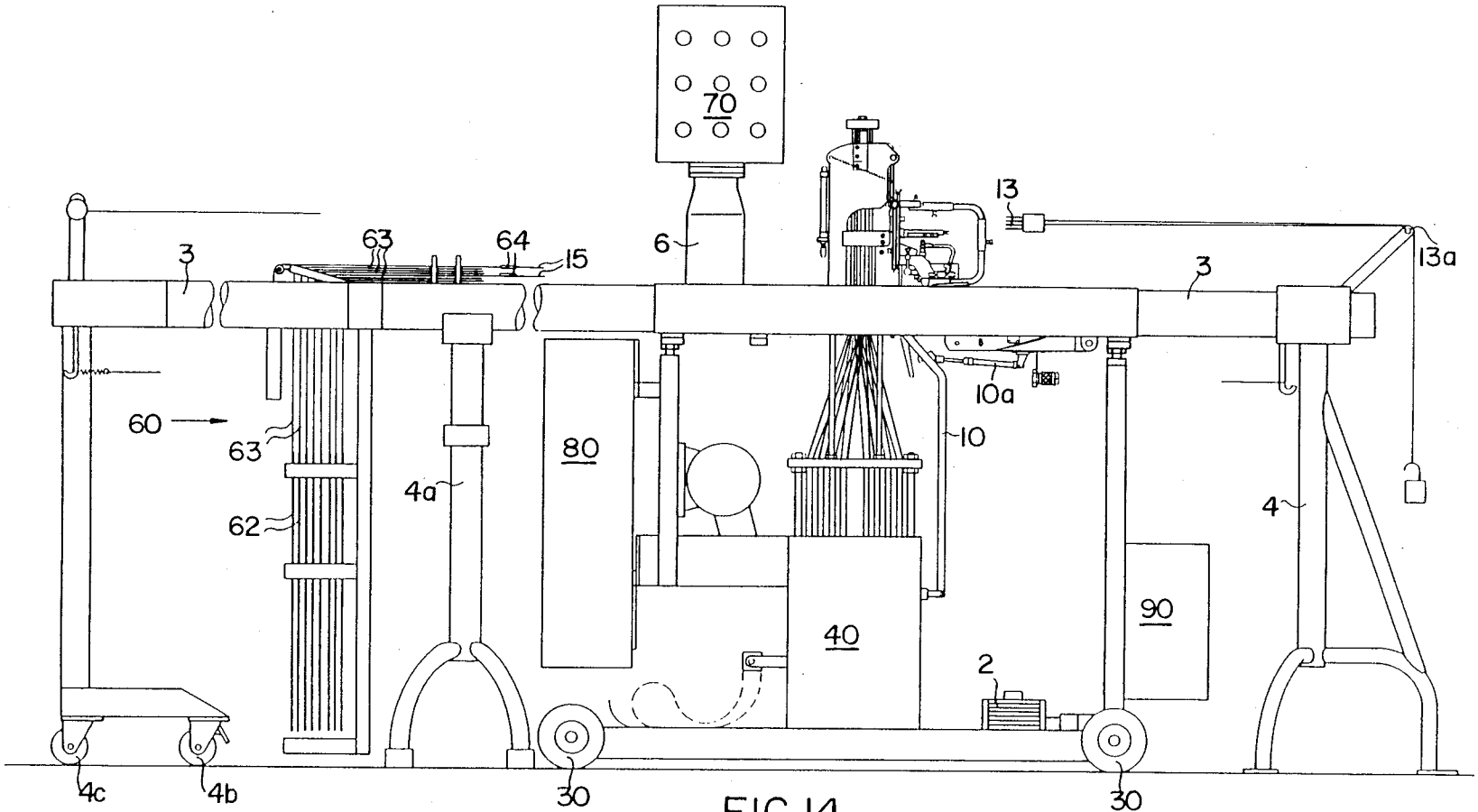
FIG. 14 is a general view of the seaming machine with travelling mechanism and single thread suspension.

Referring again to FIGS. 1 and 12–14, the frame consists in general of two stands 4, 4' and two supporting- and guiding tubes 3 for guiding wide and heavy wire cloth and additionally and providing intermediate pillars 4*a* for the support of the supporting tubes 3. The frame body 31 is guided on either side below the working plane of the machine by the two parallel supporting guiding tubes 3, the ends of which are in turn mounted on a horizontal machine table 32 of the frame 4. In general the frame 4 does not comprise wheels and is located on that side of the seaming machine, where the start-up of the seaming takes place. The frame 4 has the function of guiding and clamping of the supporting tubes 3 as well as the clamping of the auxiliary warp threads respectively by auxiliary warp strips 15, 15' and the central wire 16. The frame 4 serves furthermore for the mounting of deflection pulleys 13*a* for loading the magazine bunches 13, 13', for attachment of the connecting socket, for the power supply, and for the attachment of a compressed-air spiral tube. Referring further to FIG. 14, in a further embodiment the frame 4' four steering rollers 4*b* and 4*c* whereby the steering rollers 4*b* are provided with breaks which can be locked during operation of the seaming machine. The frame 4' also has the function of guiding and clamping of supporting tubes 3 as well as the clamping of magazine bunches 13, 13'.

The jacquard head 40 known in the art is mounted centrally on the traveling mechanism 1. The jacquard head 40 can for example be designed for 216 threads whereby 198 threads can also be used, when the first two and the last rows of jacquard cards 44 are left free in the jacquard head 40. The first two rows of the jacquard cards 44 are required for controlling a double needle 7*a* of the thread separator 7, 7'. The last row of jacquard cards can be omitted in order to improve the shed geometry. A change device 46 for the central wire 16 a pneumatic cylinder 452 is provided and is mounted on brackets 51. The central wires 16 are controlled by signals included in the weaving program. Besides the automatic operation of the jacquard head 40 the seaming machine can be operated manually with respective switches and push buttons. By means of these push buttons a manual change of shed can be accomplished.

The harness 50 is fitted with 198 threads for the example given above. That means that seams with a maximum of 198 threads can be made. For seams with a smaller number of auxiliary warp threads 15, 15', the threads should be divided symmetrical in the center of the harness 50 and if required every third or fourth harness eye 52 should be left free, depending on the number of auxiliary warp threads. The basic tension of the harness springs 53 can be altered by raising or lowering the base of the spring 54.

The single thread suspension 60 is shown detailed in FIG. 14. Thus each auxiliary warp thread 15, 15' is provided with a weight 62. For this purpose the auxiliary warp thread 15, 15' is connected to the connecting thread 63 of the weight 62 by a special coupling 64 after threading into the harness eye 52. In one embodiment the weights 62 are made from brass. With a diameter of 4 mm a weight 62 having a length of 600 mm weights approximately 65 g.

Referring again to FIGS. 1, 12–14, and 16, the thread separators 7, 7' are mounted via the bracket 51 on the traveling mechanism 1 like the above-mentioned shedding mechanism 5 (see FIGS. 3–5) respectively to the jacquard head 40. Warp threads 12, 12' chosen to be woven are released by the thread separator 7, 7' one-by-one from the magazine bunch 13, 13' and positioned for the transfer gripper 8, 8'. The force of the separating head 7b is determined by a spring 7c, which is connected to a pneumatic cylinder 7d. The thread separators 7, 7' can be adjusted horizontally and vertically with knurling screws 7e. The entire mechanism 7 to 7e, as well as that of 8 to 8g, to be discussed infra can be turned into an upper position thus allowing free access to the seam area. The size of the separating needles 7a, which are provided with two hooks 7g, 7g', for the separation of threads for fine cloth consisting of multiple layers depends on the profile of the warp threads 12, 12'. The depth of the hook 7a for round warp threads could always be 25 to 30% less than the diameter of the warp threads. Oval and rectangular warp threads require specially adapted separating needles 7a. The thread separator 7, 7' can be operated automatically as well as manually. The same holds true for the device for the tensioning of the thread separators 7f respective of the motion of the separating needles 7a.

Figure 15:
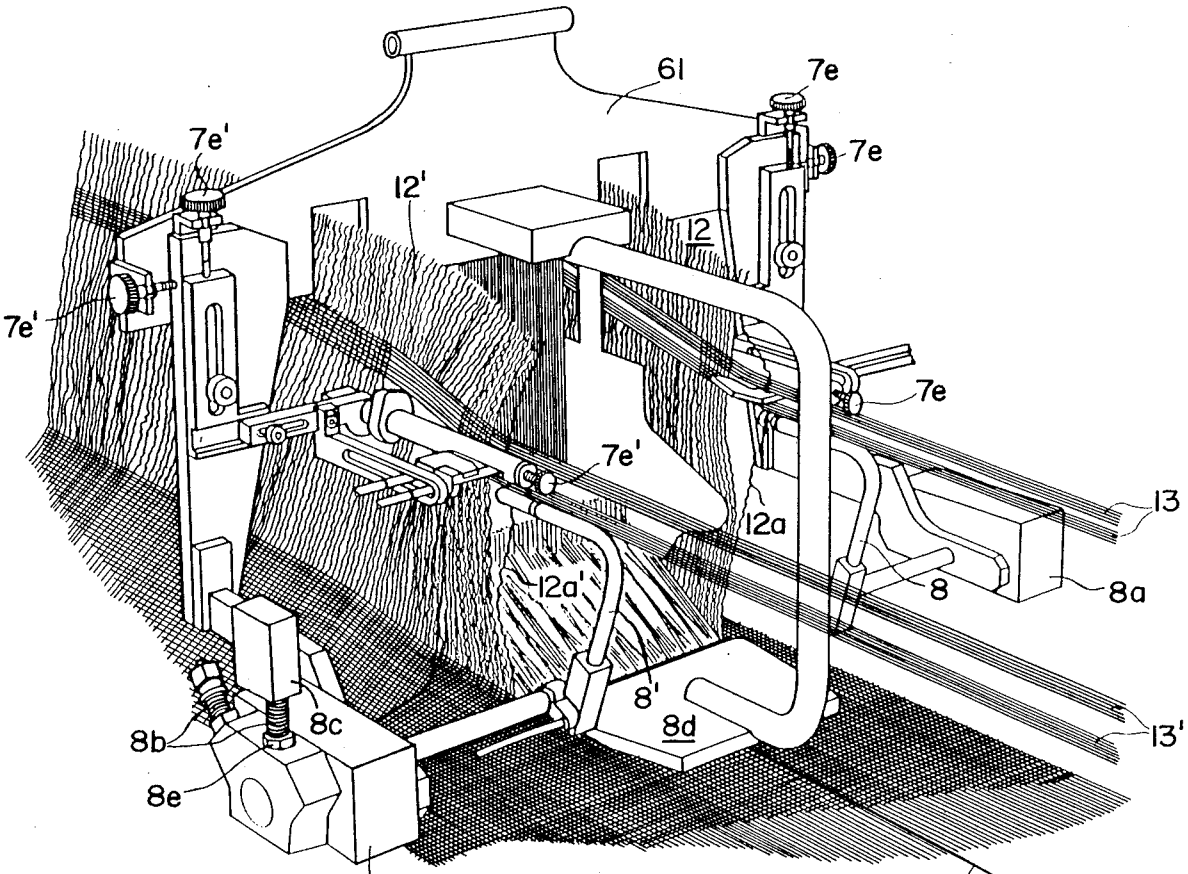
FIG. 15 is an isometric view of an assembly comprising thread separators, transfer grippers and holding-down device.
Figure 16:
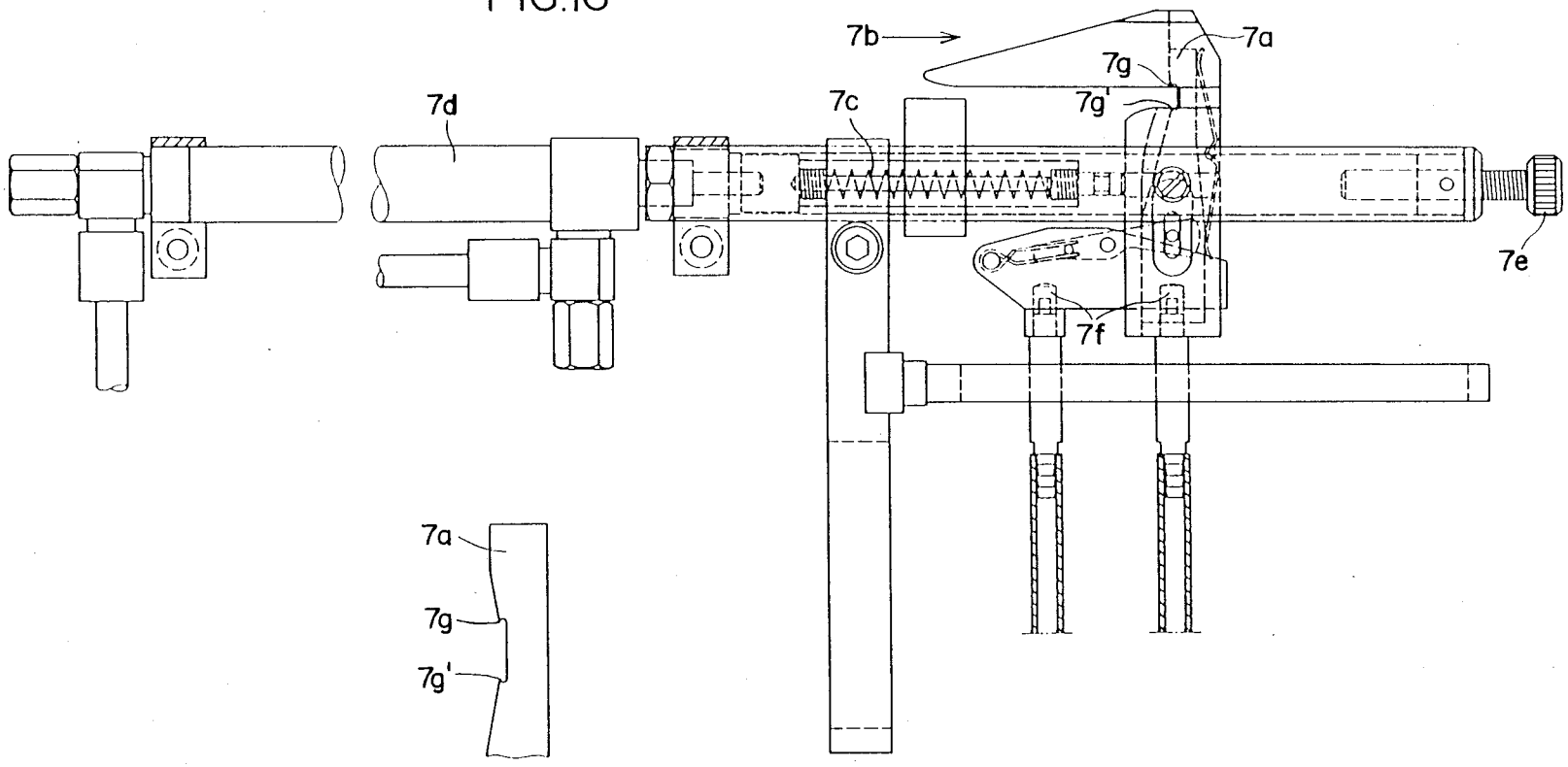
FIG. 16 is a view of the major parts of the thread separator assembly.
Figure 17:
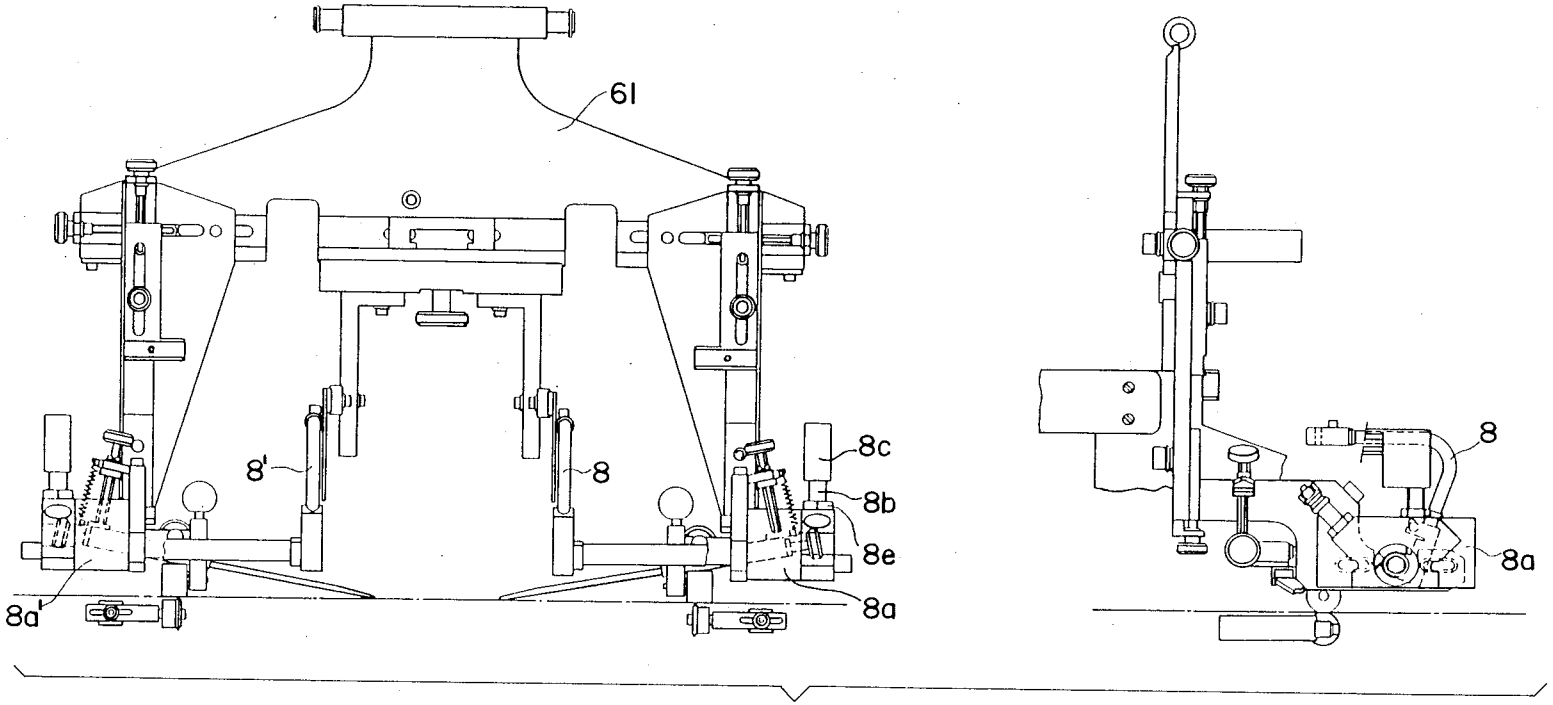
FIG. 17 is a side view and a front view of the transfer gripper assembly.
Figure 17A:
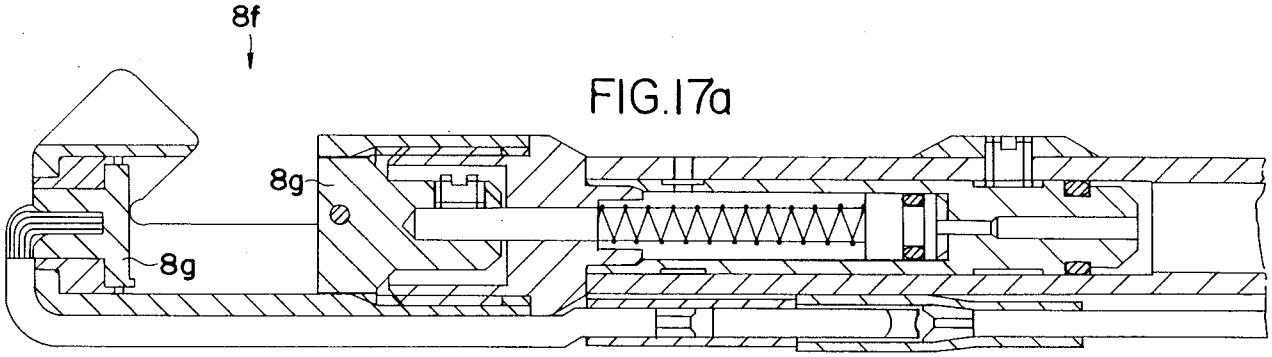
FIG. 17*a* is a sectional view of the head of a transfer gripper.

With further reference to FIGS. 15, 17, and 17a, the bracket 51 has also secured thereto thread separators 7, 7' and transfer grippers 8, 8'. As it is the case for the thread separators 7, 7' there is one transfer gripper 8 and 8' respectively provided each for one of both cloth halves, wherein the primed reference numerals relate to one cloth half and the non-primed ones relate to the opposite second cloth half. The transfer grippers 8, 8' take the single thread 12a off the thread separator 7, 7' to the threading gripper 9, 9' being in a ready position. The transfer grippers 8, 8' are driven by pneumatic rotary drives 8a (FIG. 15). The angle of swing of the transfer grippers 8, 8' can be adjusted continuously by means of stop screws 8b. For the proper control of end positions electronic indicators 8c are mounted on the stop screws 8b. For an adjustment of the end positions of the transfer grippers 8, 8' said screws are loosened on the electronic indicator elements as well as lock nuts 8e on the stop screws 8b. Following this the turning angle and thus the position of the transfer grippers 8, 8' can be adjusted with the stop screws 8b. The transfer gripper tensioners 8f are equipped with electric contacts 8g. If a thread 12a is missing the control system switches into a fault condition such that the operation of the seaming machine is holded. For the insertion of a missing thread 12a in the transfer gripper tensioner 8f (FIG. 17a) the tensioner can be held open through a push button and a switch as long as it is necessary to insert a thread by hand. In order to keep the beating-up line and the seam in the area where it is processed in the same level as the cloth, a holding-down device 8d is provided for as shown in FIG. 15.

Figure 3:
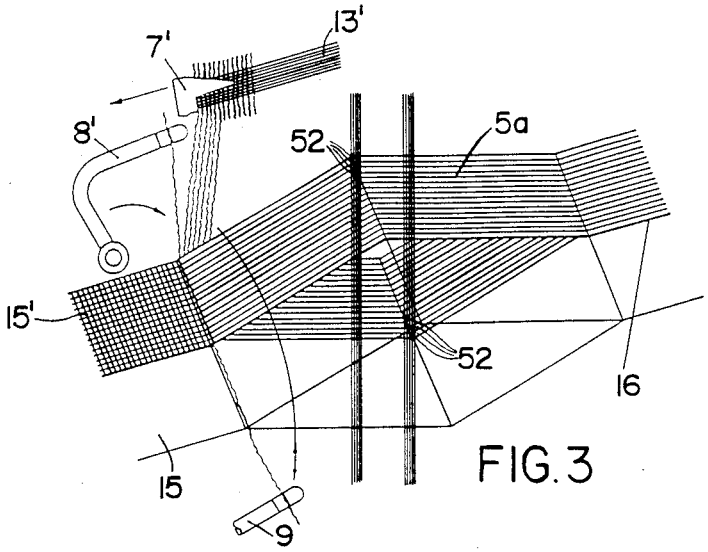
FIG. 3–5 are schematic views showing the operating steps when making the insertion-type seam for one cloth side.
Figure 4:
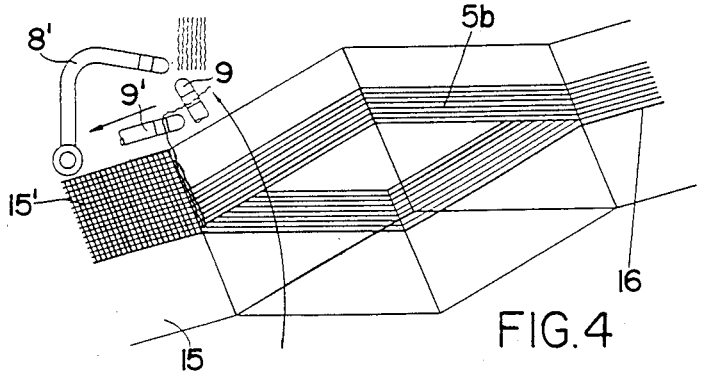
Figure 5:
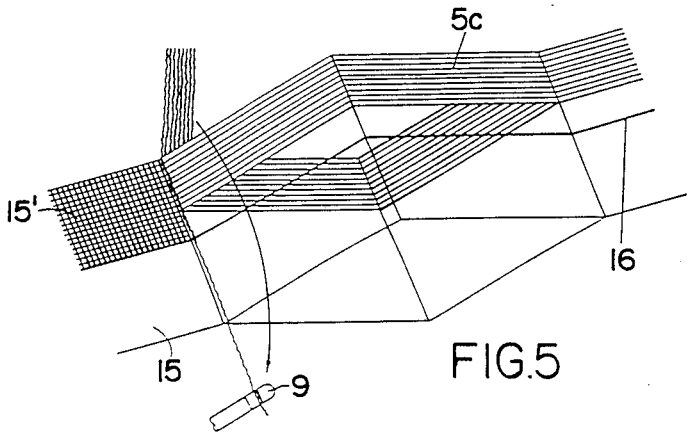
Figure 18A:
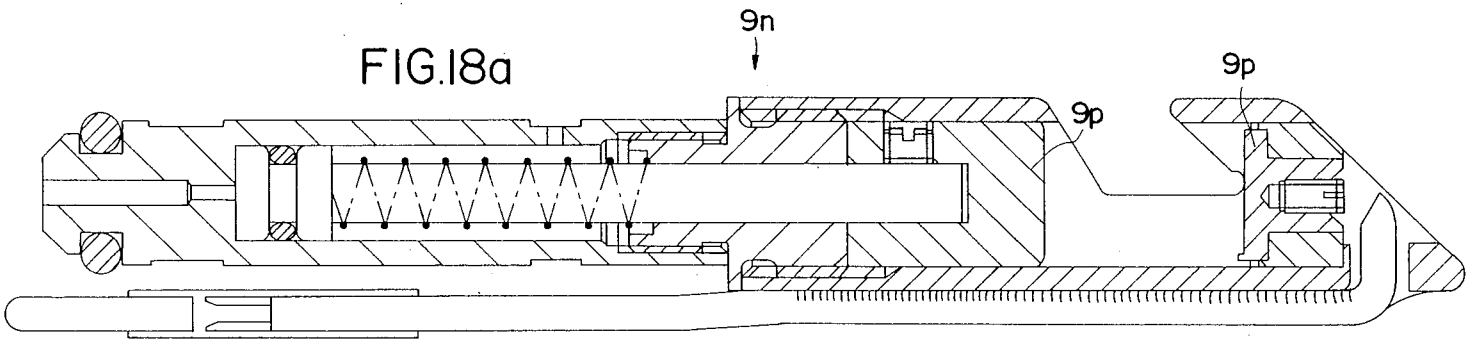
FIG. 18*a* is a sectional view of the head of the threading gripper.
Figure 18:
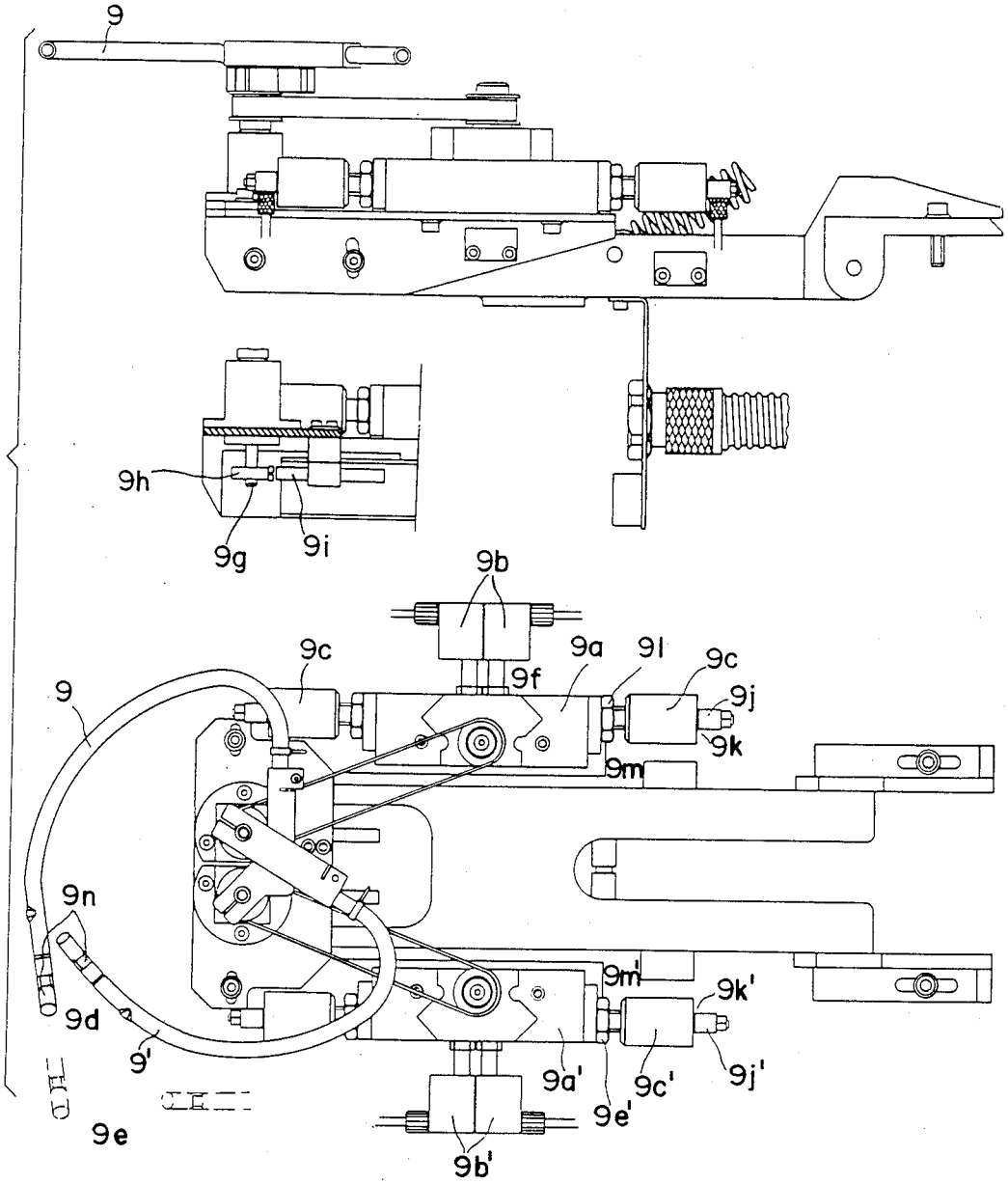
FIG. 18 is a side view and a plan view of the threading gripper assembly.

Underneath the working plane of the seaming machine the threading grippers 9, 9' (FIG. 18) as well as the two lathes 10, 10' (FIG. 19) are supported. The drawing-in grippers 9, 9' serve mainly two functions, namely taking the warp thread ends 12, 12' off the transfer grippers 8, 8' and then entering these auxiliary warp threads in the alternately opened sheds 5a, 5b, 5c of the seam as shown in FIGS. 3–5, and further the reciprocal transfer of the warp thread ends 12, 12' which are woven back. The drawing-in grippers 9, 9' are driven by pneumatic rotary drives 9a with end position indicator 9b and installed cylinders 9c for intermediate positions 9d. The end positions 9e of the drawing-in grippers 9, 9' can be adjusted continuously by means of stop screws 9f. The indicator elements 9b are fastened to the stop screws 9f and must be removed prior to an adjustment of the stop screws 9f. To confirm intermediate positions 9d, cams 9h are fitted to bottom shaft ends 9g of the drawing-in grippers 9, 9'. When the intermediate position 9d is reached the cams 9h trigger approximation initators 9i. For the adjustment of intermediate positions 9d the seaming machine is switch off with the master switch. Following this compressed air connections 9j at the cylinder bottom 9k as well as lock nuts 9l at the cylinder neck 9m have to be disconnected. Then the desired position 9d is set by turning the cylinder 9c. Afterwards the air connections 9j and the lock nuts 9l are retightened and then the cams 9h are readjusted for the confirmation of the intermediate position 9d. The gripper heads 9n (FIG. 18a) are equipped with electrical contacts 9p which in lack of a thread transmit a signal to the machine control system to switch the machine into a fault condition.

Figure 19A:
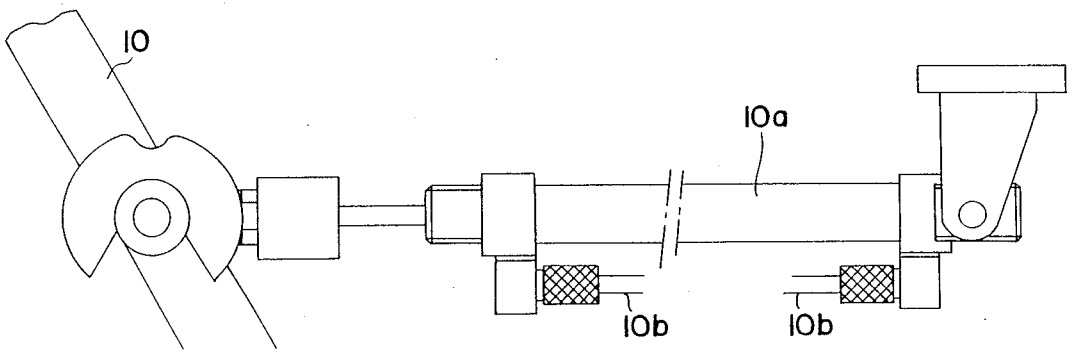
FIG. 19*a* is a side view of a lathe according to arrow A in FIG. 19.
Figure 19:
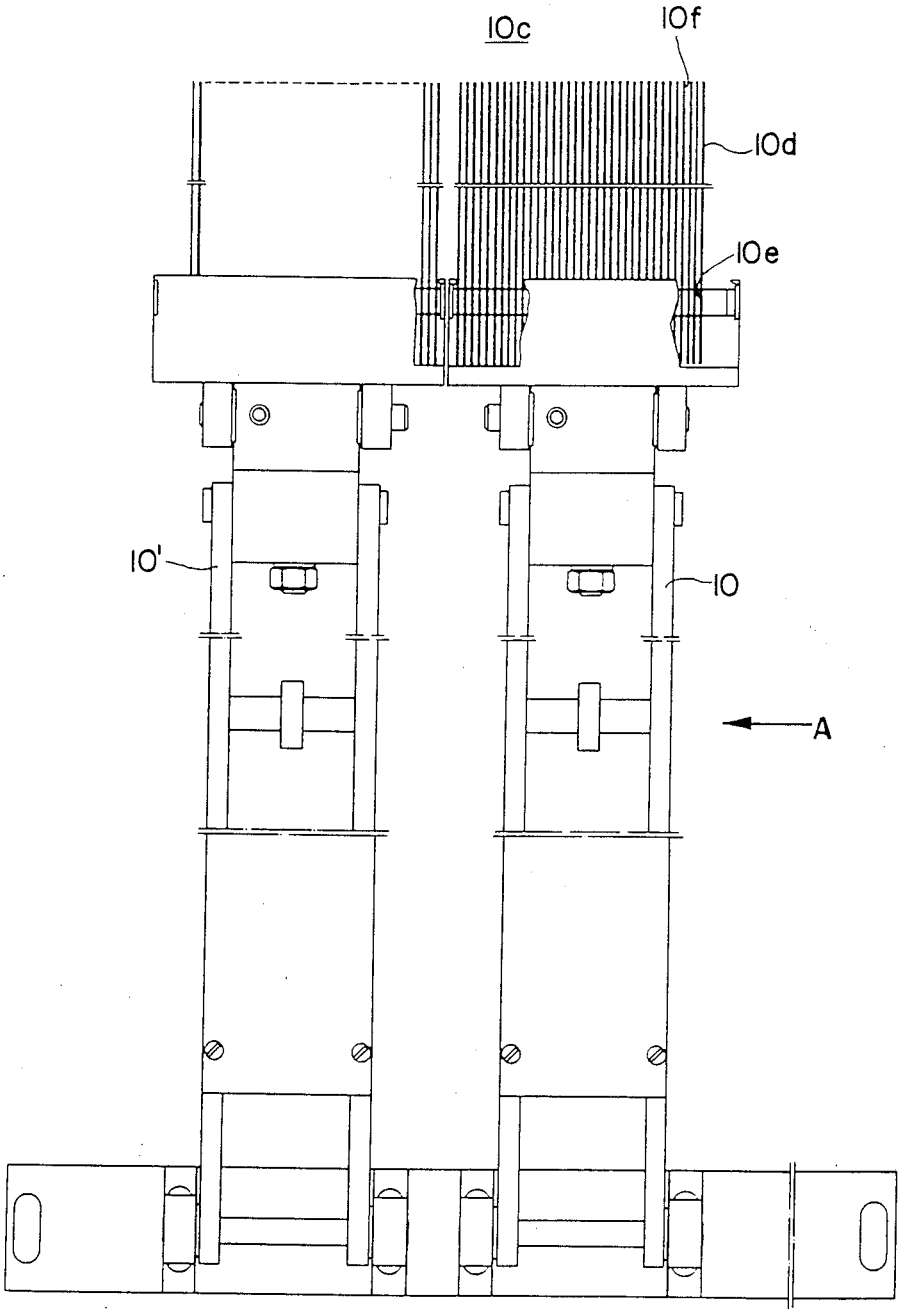
FIG. 19 is a view of both lathes.

Within the seaming machine two lathes 10, 10' are mounted as shown in FIGS. 19 and 19a whereby one is located at the operating side and the other one on the back side. The lathe 10, 10' are driven by pneumatic cylinders 10a. These are equipped with throttle valves 10b for speed adjustment of the lathes 10, 10'. The lathe reed 10c must be individually made up for each cloth from respective dents 10d and spacer discs 10e. It may then become necessary to pull through more than one auxiliary warp threads 15, 15' per opening 10f.

The bracket 6 mounts furthermore comprise switching and controlling devices which are necessary for the operation of the seaming machine and arranged in a control console 70. The switching- and indication devices arranged in the control console 70 serve the activation and control of gear-break motor 2, the jacquard head 40, the shedding devices, the thread separator 7, 7', the thread separator tensioner 7f, the transfer gripper 8, 8', the transfer gripper tensioner 8f, as well as the drawing-in gripper 9, 9' and the drawing-in gripper tensioner. Furthermore, a selector switch is provided for automatic and single step operation and a push button for emergency stop is installed.

The electric control unit 80 contains the main switch, circuit-breaker, contactors and a storage-programmable controlling unit.

The pneumatic control unit 90 contains valves for all grippers 7, 7', 8, 8', 9, 9', lathes 10, 10', insertion wires and shedding mechanism.

In FIG. 1, the wire cloth 11 to be provided with an insertion-type seam passes beneath the seaming machine, i. e., the machine travels on the wire cloth which is covered with a protective layer. An alternative way of guiding the wire cloth 11 is shown in FIG. 2, where the wire cloth is passed like a tent via two supporting rods 23, 24 across the seaming machine.

Prior to being placed in the seaming machine, the two ends 21, 22 of the wire cloth 11 to be provided with an insertion-type seam are prepared by removal of the wefts in a region having a width of ca. 10 to 20 cm, whereupon 10 to 30 wefts, depending on the weave, are combined on the warp ends 12, 12' in their exact weaving position to form a magazining bunch 13, 13'. The magazining bunches 13, 13' are secured by clamping means 14 at the frame 4, 4' of the traveling mechanism 1, only one of said stands being illustrated in FIG. 1.

Before the seam is made, a group of wires which may either consist of original wefts of the cloth or may be a strip 15, 15' also called auxiliary warp strip consisting of original wefts of the cloth and constituting the warp for the seam-weaving process performed transversely to the actual direction of the wire cloth, is positioned on either side of the wire 16 which is called central wire between the two unravelled ends of the wire cloth 11, said ends being held by the magazining bunches 13, 13'. The central wire 16 is located exactly midway between the two auxiliary warp strips 15, 15'. The auxiliary warp strips and the central wire are secured in a further clamping means 17 of the machine likewise mounted on the frame 4, 4'.

The individual wires of the auxiliary warp as well as the central wire 16 are guided in eyelets of the shedding mechanism 5 or jacquard head 40 disposed either above or below the plane of weaving on the traveling mechanism 1.

Removal and separation of the warp ends 12, 12' (FIG. 1) by means of the thread separators 7, 7' is effected in a manner known per se, identical seam forming elements such as thread separators 7, 7', transfer grippers 8, 8', drawing-in grippers 9, 9' and lathes 10, 10' being provided on either side of the seam. Initially, the transfer gripper 8' grips the warp separated by the thread separator 7' and swings it downward to the transfer position of the working plane, as will be apparent from FIG. 3. Then the drawing-in gripper 9 takes over the warp end and pulls the warp into the full shed formed by the shedding mechanism 5. Thereupon, the thus inserted warp end is beaten up to the selvedge by the lathe 10'. Now, the right-hand part of the auxiliary warp strip 15' forms an inner partial shed, as will be apparent from FIG. 4, and the same warp end is swung back by the drawing-in gripper 9 into the specified transfer position, where the drawing-in gripper 9' takes over said warp end, while the transfer gripper 8' during the transfer operation functions as locating aid by pressing against the warp. The drawing gripper 9' then tensions the warp end, whereupon the lathe 10' is again beaten up. Then the adjacent partial shed is formed in the auxiliary warp half 15', the next warp is moved to the transfer position by the transfer gripper 8' and inserted by the drawing-in gripper 9 into the now outer partial shed as can be seen from FIG. 5, whereupon the warp is again beaten up by the lathe 10'.

Figure 6:
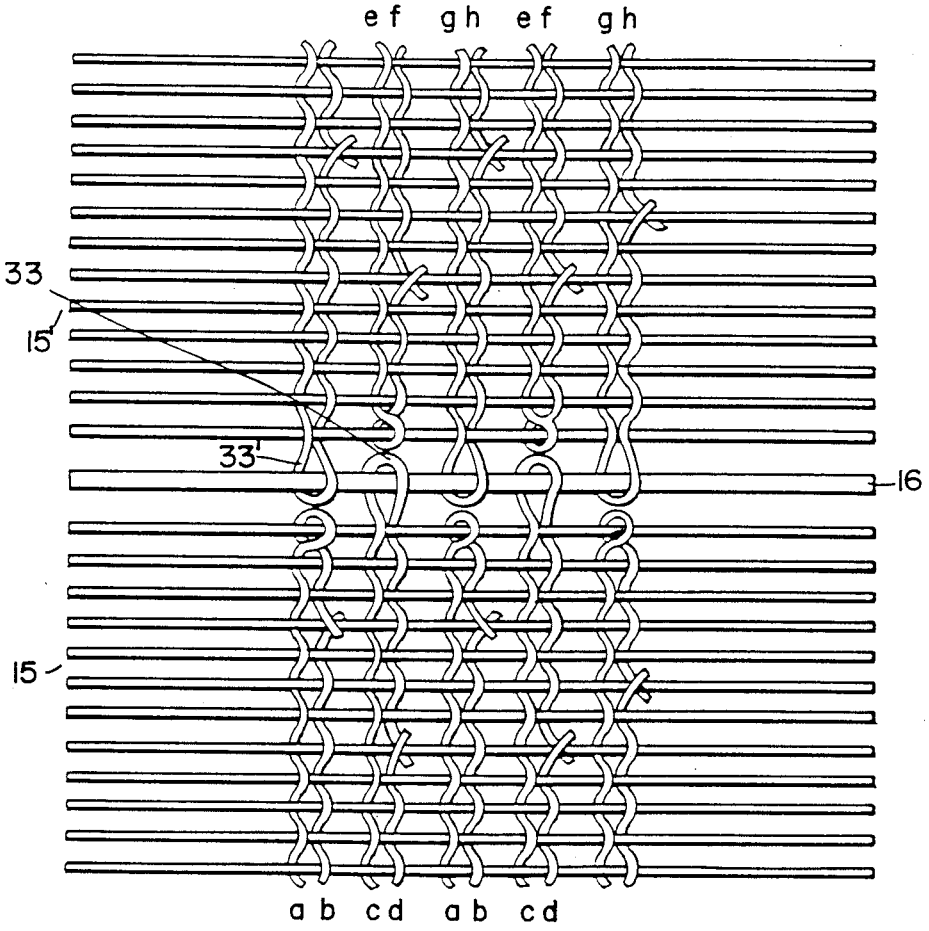
FIG. 6 is a schematic plan view of the seam of the right-hand and the left-hand cloth sides to be joined by means of a central wire.

Since during these operations the central wire 16 does not participate in the change of sheds, the warp ends also do not wind around it. This is represented in FIG. 6 by the threads or wires a and b. Subsequently, the above-described steps are repeated in the same order with the following wires or threads, c and d, but this time the central wire 16 does participate in the change of sheds and thus is included in the warp loop. Therefore, only every other warp of each cloth end forms a load-bearing warp wire loop 33, 33' capable of transferring longitudinal forces.

Subsequently, the corresponding operations are repeated with the other half 15 of the auxiliary warp strip, wherein this time beating-up is performed by the lathe 10 and the wires or threads e, f and g, h are inserted as illustrated in FIG. 6. The structure of the two lathes 10, 10' is per se known and will not be explained in detail.

Figure 7:
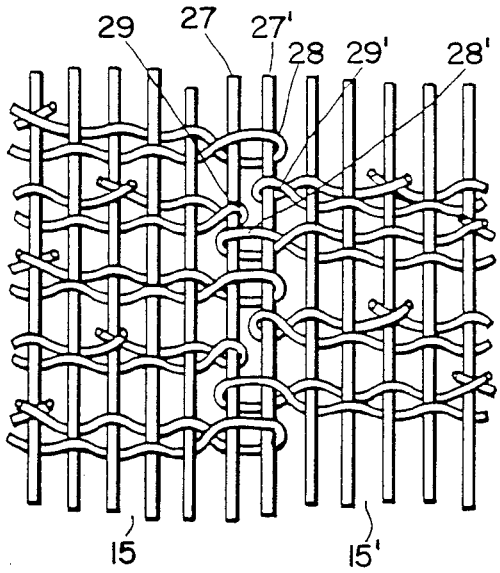
FIG. 7 is a plan view similar to FIG. 6, in which however two parallel inserted wires are used instead of a single central wire.

Instead of a single central wire 16 it is also possible to interweave a plurality of insertion wires disposed in parallel side-by-side relationship, for instance two insertion wires 27, 27' as illustrated in FIG. 7, whereby the strength of the seam is improved due to the fact that—in contrast to the seam illustrated in FIG. 6—all of the warps of the cloth participate in load bearing. The use of two inserted wires especially takes into account the fact that with a frequently used four-shaft cloth or double-weave cloth, as it is called, the loops are alternatingly long and short because of the natural crimp of the thread, as illustrated schematically in FIG. 7 for a plain cloth. In this case the two cloth ends 15, 15' are offset relative to each other in such a way that a respective long loop 28 of the left-hand wire cloth edge is passed about both inserted wires 27, 27' combined with a short loop 29' of the right-hand wire cloth edge passed about the right-hand inserted wire 27', and a short loop 29 of the left-hand wire cloth edge passed about the left-hand inserted wire 27 is combined with a long loop 28' of the right-hand wire cloth edge which is passed about both inserted wires 27, 27'.

Figure 8:
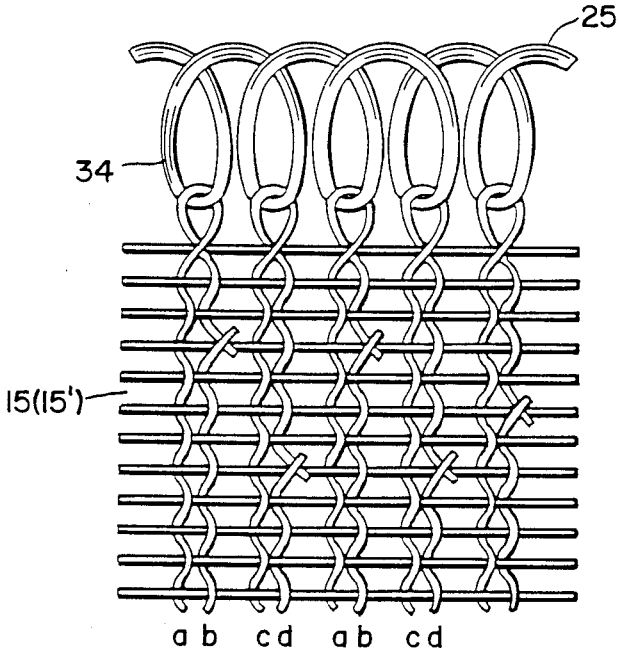
FIG. 8 is a plan view of a cloth end having a wire helix interwoven therein, each warp thread end being tied up in the helix.

In order to fully obtain the advantage of complete seam strength in another way, a modification of the method provides that the warp ends after unravelling of the right-hand and left-hand cloth sides and their stringing in the magazining hank are respectively individually interwoven with a loop 34 of a wire helix 25, each warp end being tied up in the helix as illustrated in FIG. 8. In this connection it has been found suitable to guide the wire cloth ends 15, 15' provided with the interwoven helix 25 in a device 18 illustrated in FIG. 9, said device being supported in the traveling mechanism 1 of the seaming machine. This device is particularly necessary when two parallel wire helices 25, 25' are employed, which are respectively associated with a respective side of the wire cloth. These two wire helices are not interconnected. The left-hand and the right-hand cloth ends are retained in the device 18 by means of guide rollers 19, 20 in such a way that lateral displacement or slipping is prevented. Then, the wire helices are joined externally of the seaming machine by means of a common inserted wire.

Figure 9:
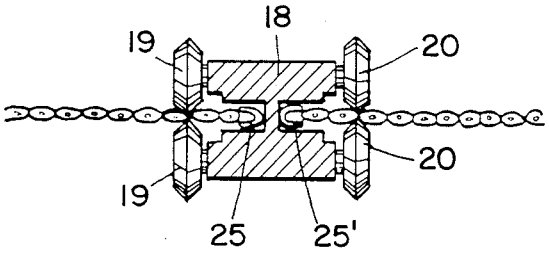
FIG. 9 is a cross-sectional view of two cloth ends each provided with a wire helix, said cloth ends being positioned by means of a device including guide rollers.

When using a common inserted or central wire, a guiding device of the type illustrated in FIG. 9 is not required, because sufficient positional stability is ensured by the common central wire.

Figure 10:
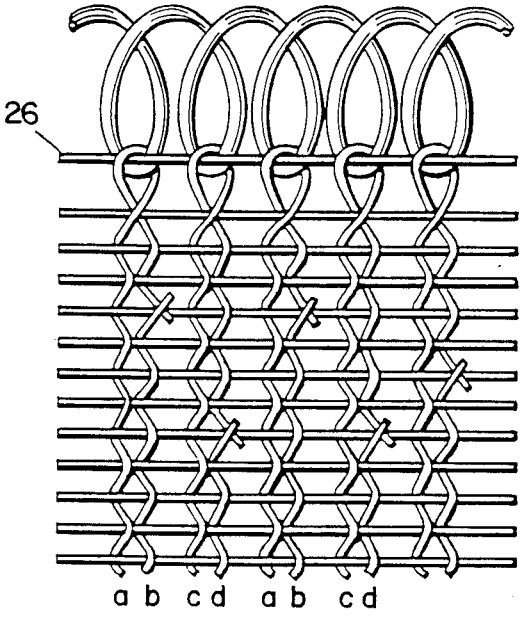
FIG. 10 is a plan view similar to FIG. 8 of a cloth end in which the wire helix is woven-in together with a wire placed therein.

The control system for the above-described seaming machine is designed in such a way that the machine may also weave a wire helix 25 of the kind shown in FIG. 8 into only one cloth side. Finally, it is also possible to interweave the wire helices, which will later be joined by a common inserted wire when the wire cloth is made endless, in the cloth ends together with a wire 26 located in said wire helices (FIG. 10).

Figure 11:
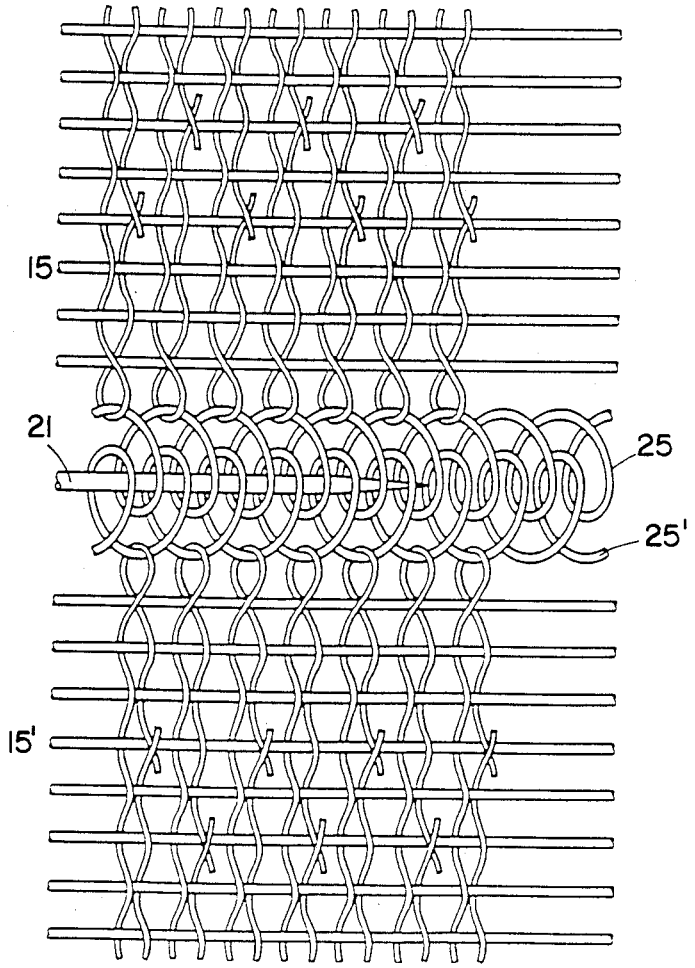
FIG. 11 is a plan view of two cloth ends each having a wire helix interwoven therein and a partially inserted central wire.

An alternative embodiment to FIG. 9, replacing the guide rollers 19, 20 with a strong, shedable central wire 21, is shown in FIG. 11. The function of the guide rollers 19, 20 is performed by the central wire 21 by connecting both wire cloth ends 15, 15' and fixing their position relative to the seaming machine.

The seaming machine is useful to provide technical woven cloths, for instance dryer cloths for dehydration machines, paper-making machines and board machines of the most veried composition, in warp and weft direction (mono- or multifilament in polyester or polyamide) and single- or multi-layer structure with insertion-type seams. Likewise, it is possible to provide base fabrics for wet felts in single- or multi-layer configuration with insertion-type seams.

For reasons of affecting the permeability it may sometimes be of advantage to have the auxiliary warps in the seam region, i.e. the wefts of the original cloth, consist of a material different from that of the remaining wefts of the cloth.

We claim:

1. A seaming machine, comprising:

a frame;

a machine table supported by said frame;

a supply of cloth;

means for separating the ends of said cloth into individual threads;

a plurality of parallel running wires extending lengthwise along said machine table;

means for transferring said individual threads to said machine table adjacent said wires; and means for weaving said threads with said wires, wherein said means for weaving produces an endless belt of cloth.

2. The invention as described in claim 1, comprising in addition a travelling mechanism, said mechanism causing reciprocating motion of said seaming machine in a rhythm consistent with said means for weaving during said weaving.

3. The invention as described in claim 2, wherein said travelling comprises:

a set of wheels supporting said frame; and a gearbreak motor connected to said set of wheels, said motor encouraging reciprocating motion of said frame in both forward and rearward longitudinal directions.

4. The invention as described in claim 3, comprising in addition a disconnect device for disconnecting said motor, said device permitting manual reciprocating movement of said seaming machine.

5. The invention as described in claim 1, wherein said means for separating the ends of said cloth into individual threads comprises a pair of thread separators, said separators dividing singular threads from said cloth at regular intervals.

6. The invention as described in claim 5, wherein said means for transferring said individual threads comprises a pair of transfer grippers, said grippers acting to transfer said individual threads from said thread separators at a given thread tension.

7. The invention as described in claim 6, comprising in addition a holding-down device, said holding device holding said transferred threads in a position above said machine table adjacent said plurality of wires.

8. The invention as described in claim 6, wherein said means for weaving said threads with said wires comprises a pair of threading grippers, said grippers receiving said threads from said transfer grippers.

9. The invention as described in claim 8, comprising in addition a shedding mechanism for weaving said threads with said wires, said threading grippers transferring said threads to said shedding mechanism.

10. The invention as described in claim 9, wherein said shedding mechanism comprises:

a jacquard container for housing said threads to be woven; and a pair of lathes, said lathes operably connected to said transfer and threading grippers, said lathes further causing said threads and wires to be woven together into a selvedge material.

11. The invention as described in claim 10, wherein said plurality of parallel-running wires comprises one or more central wires, said central wires enabling the creation of a variety of woven patterns.

12. The invention as described in claim 10, wherein said shedding mechanism is capable of weaving helix-shape wires with said threads.

13. The invention as described in claim 1, comprising in addition an electronic control unit mounted on said frame, said electronic unit being programmed to provide various weaving procedures to said weaving machine.

14. The invention as described in claim 1, comprising in addition a pneumatic control unit mounted on said frame, said pneumatic unit operating said thread separators and said thread transfers and transfer grippers.

* * * * *